US007458653B2

(12) United States Patent
Nlend et al.

(10) Patent No.: US 7,458,653 B2
(45) Date of Patent: Dec. 2, 2008

(54) POSTAGE METER SYSTEM HAVING A CONTROLLED LEVEL OF INK

(75) Inventors: Bénédicte Nlend, Nogent sur Marne (FR); Dany Ray, Juziers (FR); Patrick Blanluet, Paris (FR)

(73) Assignee: NEOPOST Technologies, Bagneux (FR)

( * ) Notice: Subject to any disclaimer, the term of this patent is extended or adjusted under 35 U.S.C. 154(b) by 387 days.

(21) Appl. No.: 11/179,343

(22) Filed: Jul. 12, 2005

(65) Prior Publication Data

US 2006/0012626 A1 Jan. 19, 2006

(30) Foreign Application Priority Data

Jul. 13, 2004 (FR) ..... 04 07791

(51) Int. Cl.
*B41J 2/195* (2006.01)

(52) U.S. Cl. ..... 347/7

(58) Field of Classification Search ..... 347/7
See application file for complete search history.

(56) References Cited

U.S. PATENT DOCUMENTS 5,528,269 A * 6/1996 Drogo et al. ..... 347/19
5,831,646 A * 11/1998 Kuronuma et al. ..... 347/30
6,106,088 A * 8/2000 Wafler ..... 347/7
6,213,600 B1 4/2001 Kobayashi et al. ..... 347/86
6,312,083 B1 * 11/2001 Moore ..... 347/19
6,538,681 B2 * 3/2003 Lee ..... 347/211
7,171,368 B1 * 1/2007 Sisson et al. ..... 705/1
2001/0020961 A1 9/2001 Pauschinger ..... 347/19
2002/0003566 A1 1/2002 Lee ..... 347/211

FOREIGN PATENT DOCUMENTS

EP 1 093 930 A2 4/2001
GB 2 354 735 A 4/2001

* cited by examiner

*Primary Examiner*—Matthew Luu
*Assistant Examiner*—Brian J Goldberg
(74) *Attorney, Agent, or Firm*—Sughrue Mion, PLLC

(57) ABSTRACT

A method of disabling operation of a disposable print module that has an ink reservoir and a plurality of ink ejection nozzles including unused nozzles, and that serves to be mounted on a base of a postage meter, the method including the following steps: forming, in a prior step, a residual ink level counter using a determined first group of the unused nozzles; determining the volume of ink consumed; destroying one of the unused nozzles of the residual ink level counter every time the print module is mounted on a different postage meter base; destroying one of the unused nozzles of ink consumed exceeds a predetermined ink level; and disabling operation of the print module when all of the unused nozzles of the residual ink level counter have been destroyed.

7 Claims, 5 Drawing Sheets

FIG.2
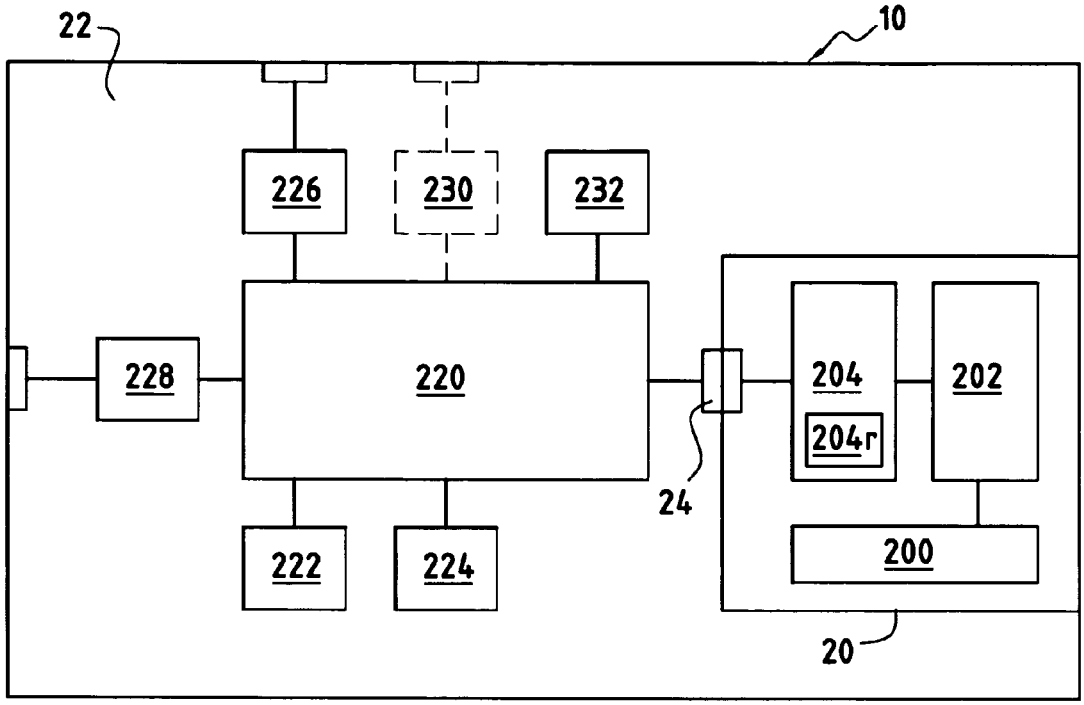
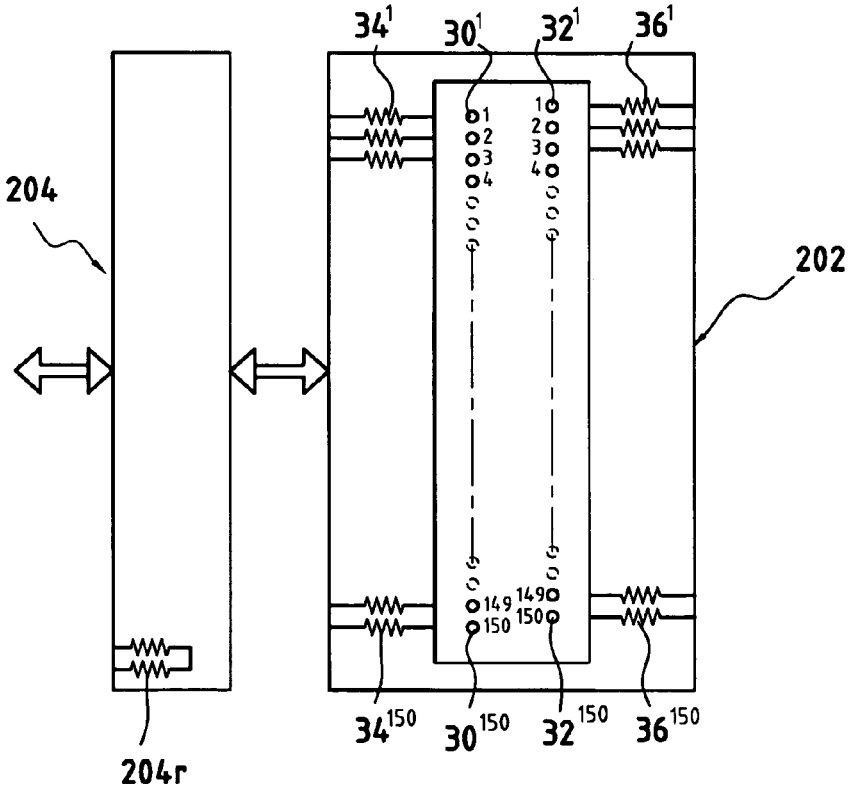
FIG.4

POSTAGE METER SYSTEM HAVING A CONTROLLED LEVEL OF INK

CROSS-REFERENCE TO RELATED APPLICATIONS

This application claims priority from French Patent Application No. 04 07791, filed on Jul. 13, 2004.

TECHNICAL FIELD

The present invention relates to the field of mail handling, and more particularly to the field of postage meters or "franking machines" of the kind including a disposable digital inkjet print module.

PRIOR ART

Postage meters having disposable print modules are well known, in particular from European Patent Application EP 0 875 862. Such a print module conventionally has an array of resistors, the resistances of which correspond to an identity number. That number, which is, in general, attributed by the manufacturer of the module, e.g. the American supplier Hewlett Packard, serves to implement a security process for making printing secure and that is needed for limiting fraud, which is always possible because of the monetary value attributed to the postal imprint.

European Patent Application EP 1 132 868 illustrates such a security process performed on a standard print module in order to make it compatible with use in mail handling. That document proposes to add memory means to the module, those memory means containing both a second identity number attributed by the dealer of the postage meter or by the postal administration, and a secure Message Authentication Code (MAC) obtained on the basis of the two identity numbers and of a secret key that is known only to the dealer or to the postal administration.

Such a print module is entirely satisfactory for procuring security for data interchanged with the postage meter in which it is incorporated (i.e. with the "base" of the postage meter). However, it still suffers from a drawback as regards managing filling the print module with ink. Since postal ink has specific color and consistency characteristics, the print module cannot be refilled merely with any type of ink, and, in practice, the postage meter dealer or the postal administration prevent any further printing when the ink reservoir of the print module is empty, and require that the print module then be discarded. Unfortunately, with the above-described structure, data interchange with the base of the postage meter is interrupted, by resetting the MAC, only when a low ink level is detected in the reservoir. Therefore, so long as that level has not been reached, the user can change the module or refill the module with unauthorized inks indefinitely, and thus continue to print non-compliant postal imprints.

OBJECTS AND DEFINITION OF THE INVENTION

An object of the present invention is thus to propose a method of disabling operation of a postage meter including a disposable print module that does not suffer from the above-mentioned drawback. Another object of the invention is to propose a method that costs less to implement than the methods used in conventional secure print modules.

These objects are achieved by a method of disabling operation of a disposable print module that has an ink reservoir and a plurality of ink ejection nozzles including unused nozzles, and that serves to be mounted on a base of a postage meter, the method comprising the following steps:

- forming, in a prior step, a residual ink level counter using a determined first group of said unused nozzles;
- determining the volume of ink consumed;
- destroying one of said unused nozzles of said residual ink level counter every time said print module is mounted on a different postage meter base;
- destroying one of said unused nozzles of said residual ink level counter every time said volume of ink consumed exceeds a predetermined ink level; and
- disabling operation of the print module when all of said unused nozzles of said residual ink level counter have been destroyed.

Thus, by means of this flow management rather than threshold management, fraudulent filling is avoided. The absence of any memory element at the disposable print module, unlike in the prior art, simplifies its physical structure that is then similar to the standard model and thus costs less, and is more reliable, while continuing to offer equivalent security. By destroying a nozzle every time a module is changed, printing with an empty reservoir is avoided.

Advantageously, other information relating to the disposable print module, such as a color code or a date of manufacture, is formed on the basis of a third determined group of said unused nozzles.

Determining the volume of ink consumed is performed by counting the droplets of ink ejected by said plurality of ink ejection nozzles, and said predetermined level of ink is equal to (100/n)% of the total volume of said ink reservoir, the number n corresponding to the number of said unused nozzles forming said first determined group of said unused nozzles.

The method may further comprise the following steps: forming, in a prior step, a secure message authentication code (MAC) on the basis of a second determined group of said unused nozzles; reading said secure message authentication code; comparing said secure message authentication code with a check code; and disabling operation of the print module when the two codes are not identical.

Advantageously, said comparison of said secure authentication code with said check code takes place at a remote computer server to which said postage meter base is connected.

BRIEF DESCRIPTION OF THE DRAWINGS

Other characteristics and advantages of the present invention appear from the following description given by way of non-limiting indication, and with reference to the accompanying drawings, in which:

FIG. 2 is a block diagram of the internal electronic structure of the postage meter of FIG. 1;

FIG. 4 diagrammatically shows the electronic circuits of the print module of FIG. 3;

DETAILED DESCRIPTION OF A PREFERRED IMPLEMENTATION

Figure 1:
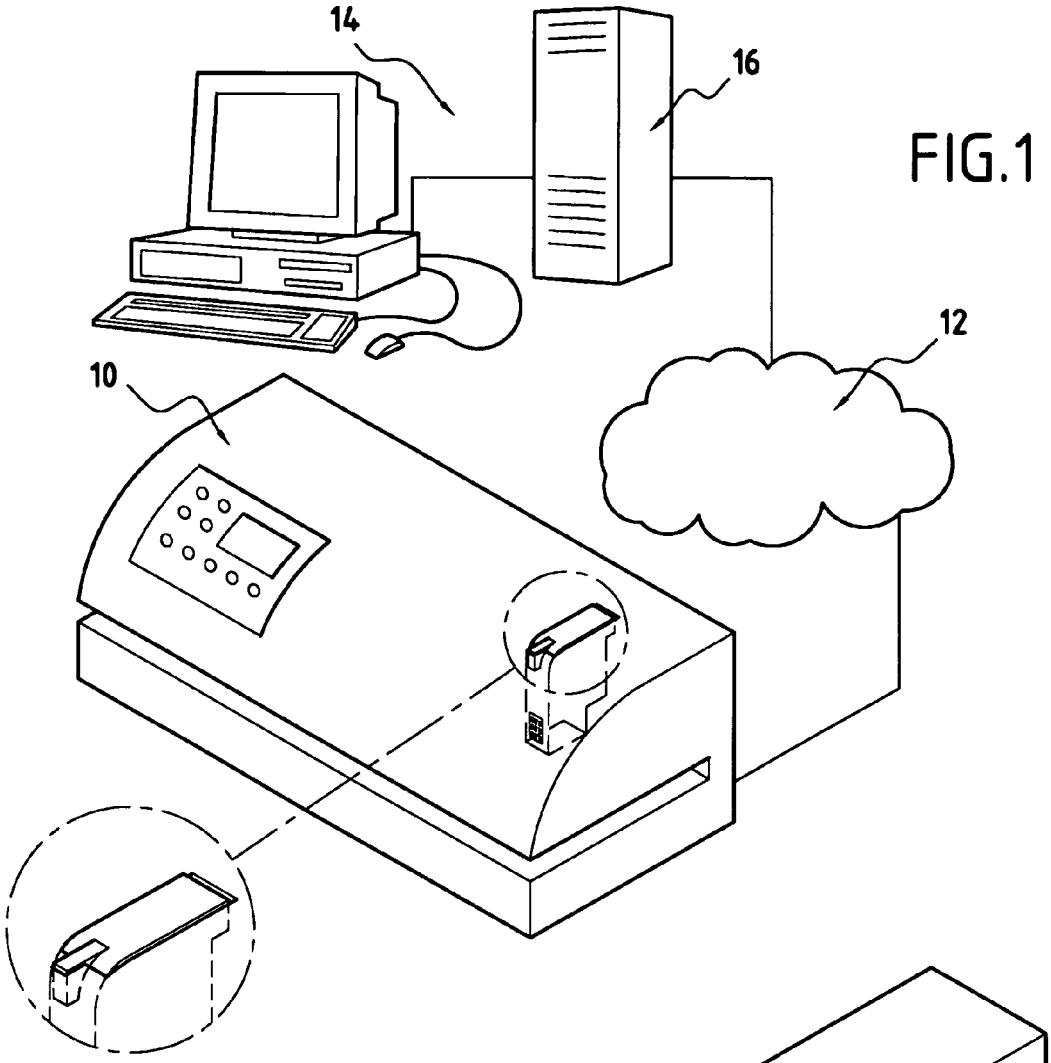
FIG. 1 diagrammatically shows architecture for a mail franking system incorporating a postage meter of the invention.

FIG. 1 shows the architecture of a mail franking system that implements the present invention. The system conventionally includes a postage meter for franking mail items 10 that is connected via a wired communications network 12 to a remote computer server 14 of the postage meter dealer or of the postal administration, the server incorporating a database 16. The network can be of the analogue type (of the Public Switched Telephone Network (PSTN) type) or of the digital type (of the Integrated Services Digital Network (ISDN) type), and the link between the meter and the server is a link that is made secure by enciphering or signing so as to make it possible, in particular, to give new credit to the postage meter from the computer server.

FIG. 2 is a simplified block diagram showing the electronic structure of the postage meter 10. In order to enable the invention to be understood better, the electronic circuits relating to controlling the motors for conveying the mail items and to controlling the various sensors have been omitted even though they naturally exist as they do in any postage meter.

The postage meter incorporates a disposable print module 20 that is preferably of the ink jet type, including an ink reservoir 200, ejection means for ejecting the ink (conventionally ink jet nozzles), and control means 204 for controlling the ejection means. Said control means or "drivers" incorporate an array of resistors 204*r* for storing an identity number ID1 of the disposable print module.

The disposable print module 20 is connected to a base 22 of the postage meter that is conventionally organized around its processor means 220, which are advantageously microprocessor means, with a keypad 222, a display screen 224, and various interfaces, in particular an interface 226 for interfacing with the wired communications network 12, a serial and/or parallel universal interface 228 for interfacing with a compatible external device (e.g. a weigh module if the meter is not provided with such a module), and optionally an interface 230 for interfacing with a smart card reader. In addition, the base 22 includes a secure module 232 that is not accessible to the user and that conventionally includes the accounting device for keeping account of the franking, with its up-counters and its down-counters, and a graphics memory containing all of the images necessary for printing the postal imprint. The link between the base 22 of the postage meter and the disposable print module 20 is provided by a series of electrical contacts 24.

Figure 3:
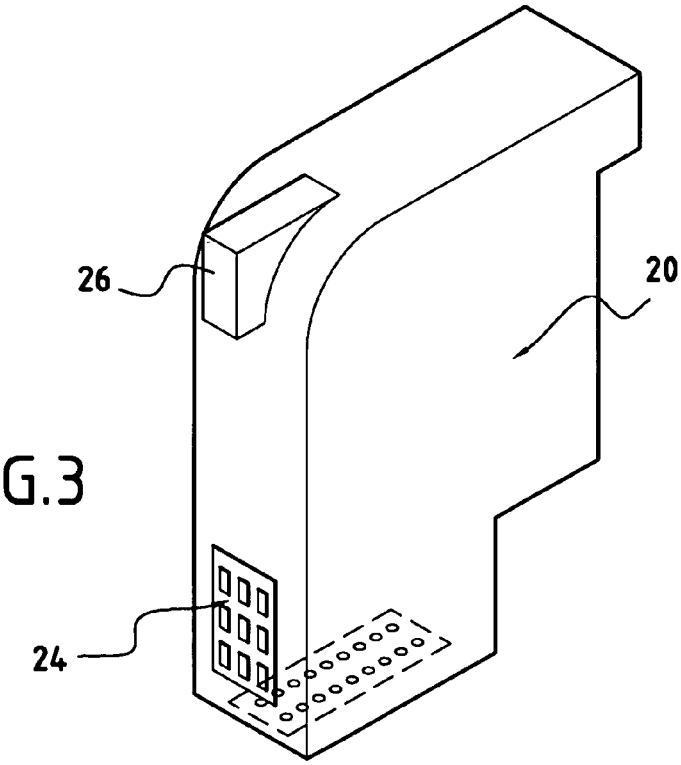
FIG. 3 is a perspective view of a disposable print module integrated in the postage meter of FIG. 1.

FIG. 3 is a perspective view of a disposable print module of the invention. This print module, which is conventionally disposed transversely to the direction in which the mail items are conveyed through the postage meter, includes a keying mechanism 26 for physically preventing the module from being mounted in a standard general-purpose printer. The module has external contacts 24A connected to the array of resistors 204*r* (see FIG. 4) and serving to co-operate with corresponding contacts disposed on the base of the postage meter. The American supplier Hewlett Packard distributes disposable print modules for ink jet printers, e.g. the HP 51645A type model, which disposable print modules include such an array of resistors for storing a unique identity number associated with the module and readable from an external module.

FIG. 4 shows the electronic circuits of the print module in more detail. The print module has a plurality of ink ejection nozzles $\mathbf{30}^{1}$-$\mathbf{30}^{150}$; $\mathbf{32}^{1}$-$\mathbf{32}^{150}$ (conventionally 300 nozzles distributed in alternation in two rows of 150 nozzles each, so as to define a printing resolution of 600 dots per inch (dpi)). Each nozzle is associated with a resistor $\mathbf{34}^{1}$-$\mathbf{34}^{150}$; $\mathbf{36}^{1}$-$\mathbf{36}^{150}$ which, when activated (i.e. when a current of determined characteristics is caused to pass through it), causes ink to be sucked from the reservoir 200 and to be ejected via the corresponding nozzle.

In practice, not all of the nozzles are used, and, in particular, when a printing resolution of 300 dpi is sufficient, which it is in many countries in which the postal administrations do not require higher resolution, a whole row of nozzles is not used, i.e. 150 nozzles.

In the invention, it is proposed to use some of the unused nozzles to form a residual ink level counter by destroying them as the content of the ink reservoir decreases. The number of ink levels (number of bits of the counter) corresponds to the number of unused nozzles. The unused nozzles thus constitute an ink consumption gauge whose minimum increment depends on the number of nozzles assigned to the gauge-forming counter. For example, with 40 unused nozzles, a 40-bit counter is obtained that makes it possible to have an increment of 2.5% of the total volume of the ink reservoir, with 37 unused nozzles, a 37-bit counter is obtained making it possible to have an increment of 2.7%, and with 20 unused nozzles, a 20-bit counter is obtained making it possible to have an increment of 5% only. More generally, with n unused nozzles, the residual ink level counter has n ink levels, each corresponding to a predetermined ink level equal to (100/n)% of the total volume of the ink reservoir. It should be noted that it is also possible to imagine that the predetermined ink level does not correspond to a given set percentage of the total ink volume of the ink reservoir but rather to a level that is determined and different depending on the level of ink remaining in the reservoir.

The other unused nozzles are advantageously used to create a second identity number ID2 and a MAC that thus no longer need to be stored in a memory as they do in Patent Application EP 1 132 868 and, if the number of nozzles so permits, in particular when a single row of nozzles is used (printing resolution of 300 dpi), said other unused nozzles are also used to store other information relating to the print module such as a color code or a date manufacture (month-year).

The second identity number ID2, the MAC, and optionally the other information is written in the print module while it is being manufactured by burning out the unused nozzles in question by exciting said nozzles and passing current sufficient to destroy the associated resistors. Thus, the prior security level is conserved or even reinforced by adding other information to the numbers ID1 and ID2 in order to obtain the MAC which, as above, is computed at the time of manufacture on the basis enciphering the two numbers by means of a secret key known only to the dealer or to the postal administration.

Conversely, the nozzles that correspond to the residual ink level are not burnt out at the time of manufacture but rather while the postage meter is in operation. For this purpose the ink level in the ink reservoir 200 is checked periodically and, on the basis of this check, the processor means 220 of the base, via the control means 204 of the print module, which control means then act as destruction means, then cause an unused nozzle to be destroyed for each ink level increment exceeded. As above, this destruction is obtained by exciting the nozzle and by passing a current that is sufficient to melt its associated resistor. The ink level is checked in known manner by counting the droplets of ink ejected by the nozzles or by any other equivalent means.

Figure 5:
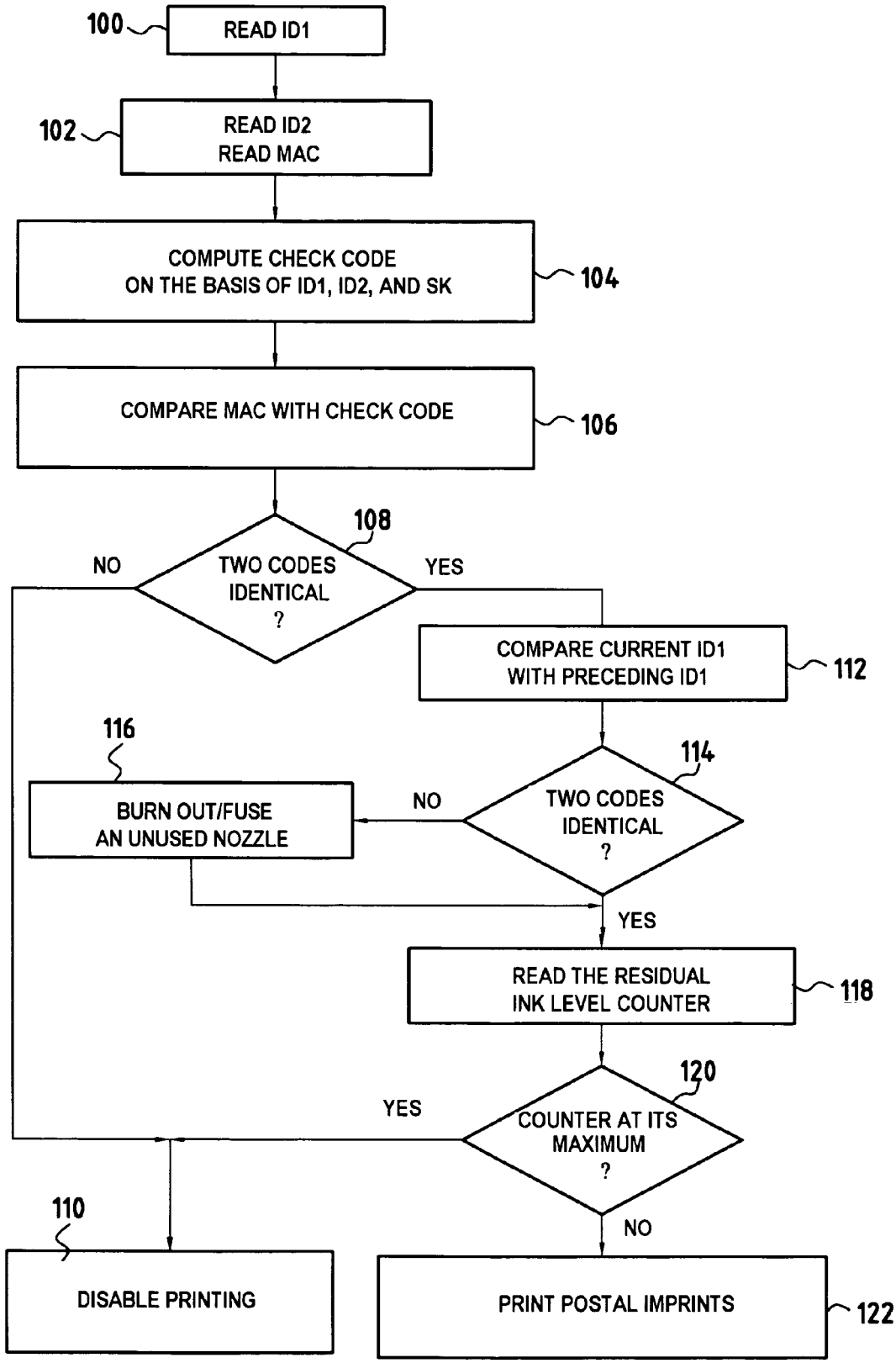
FIGS. 5 and 6 are flow charts showing the method whereby the base of the postage meter recognizes the print module.

A first example illustrating the different operations enabling data interchange between the print module 20 and the base 22 of the postage meter to be made secure in order to guarantee fraud-proof printing is shown in the flow chart of FIG. 5.

Figure 7:
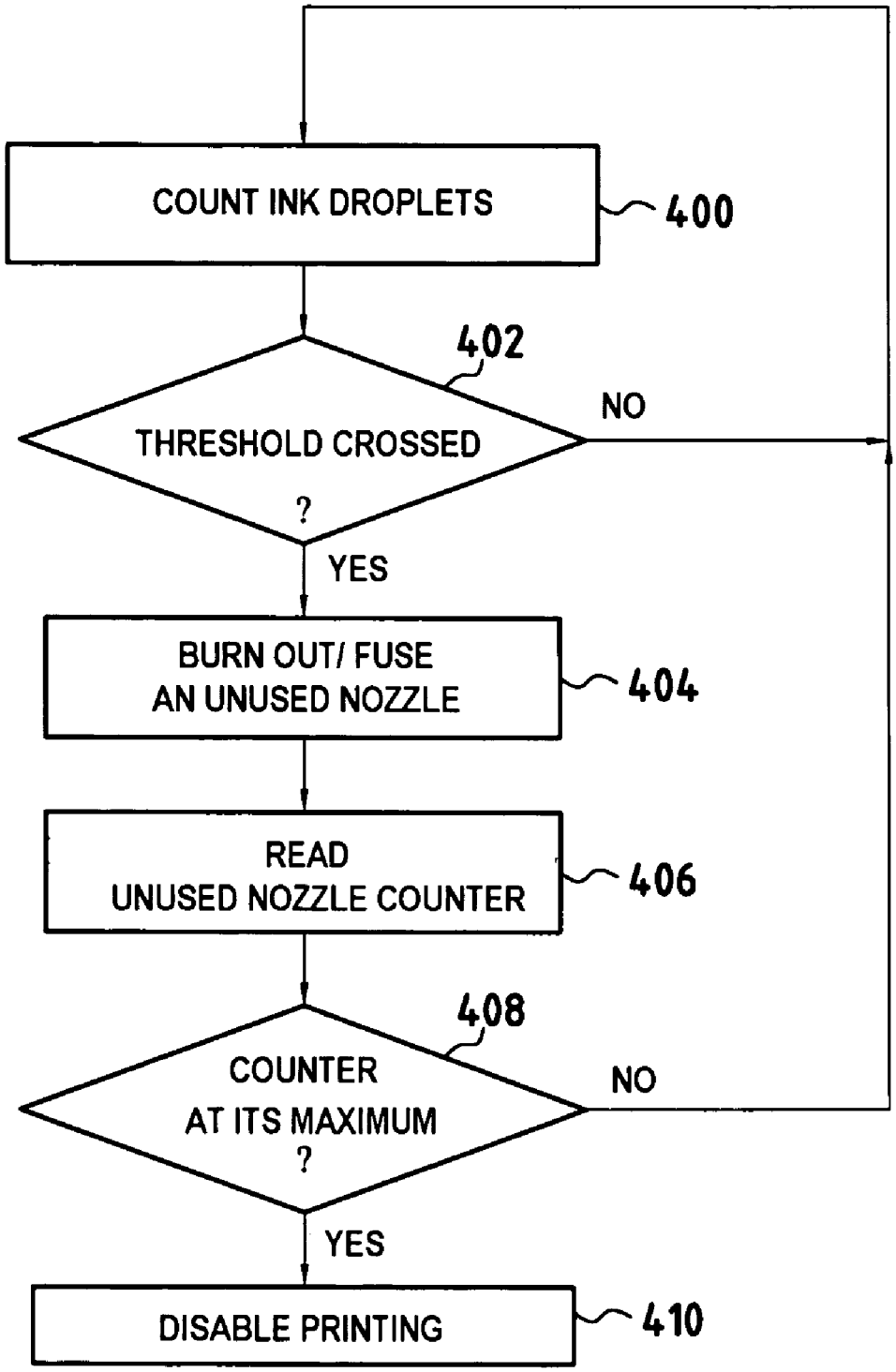
FIG. 7 is a flow chart showing how a residual ink level counter is managed in accordance with the invention.

In this first example, the security process is implemented only between the print module and the base of the postage meter. It is repeated each time the postage meter is switched on, i.e., in practice, on a daily basis. Firstly, in a first step 100, the processor means 220, via the electrical contacts 24, read the first identity number ID1 corresponding to the manufacturer's code of the print module. Then, in a step 102, via the same contacts, the processor means 220 of the base of the postage meter read the unused nozzles corresponding respectively to the second identity number ID2 and to the MAC. In another step 104, a check code is computed at the processor means 220 on the basis of the enciphering of ID1 and ID2 received from the print module by means of the original secret key SK stored with its encryption algorithm in the secure module 232. In a step 106, the MAC received from the print module is compared with the MAC generated in the base of the postage meter, and, in the event that they are not identical (answer to the test of step 108 "no"), and optionally after a predetermined number of fruitless attempts, printing is disabled in a last step 110. Otherwise (answer to the test of step 108 "yes"), in a step 112, the identity number ID1 that has just been read is compared with the identity number ID1 that was read (and recorded) the last time the postage meter was switched on. If these two numbers are different (answer to the test of step 114 "no"), this means that the print module has been changed between successive occasions on which the postage meter has been switched on, and so, in a following step 116, one of the unused nozzles of the residual ink level counter is burnt out. Otherwise (answer to the test of step 114 "yes"), in a step 118, the residual ink level counter is read. If the counter is at its maximum value, i.e. if all of the nozzles of which it is constituted are burnt out (answer to the test of step 120 "yes"), then the process goes to the last step 110 in which printing is disabled. Otherwise (answer to the test of step 120 "no"), the conventional process of printing postal imprints that incorporates updating the residual ink level counter as shown in FIG. 7 can be started in step 122.

This operation of burning out a nozzle when a print module is changed is performed for precautionary reasons. Since the ink level is estimated by thresholds at the counter, the ink level in the newly-loaded print module is not known with precision. Burning out a nozzle thus makes it possible to avoid printing with an empty cartridge.

Figure 6:
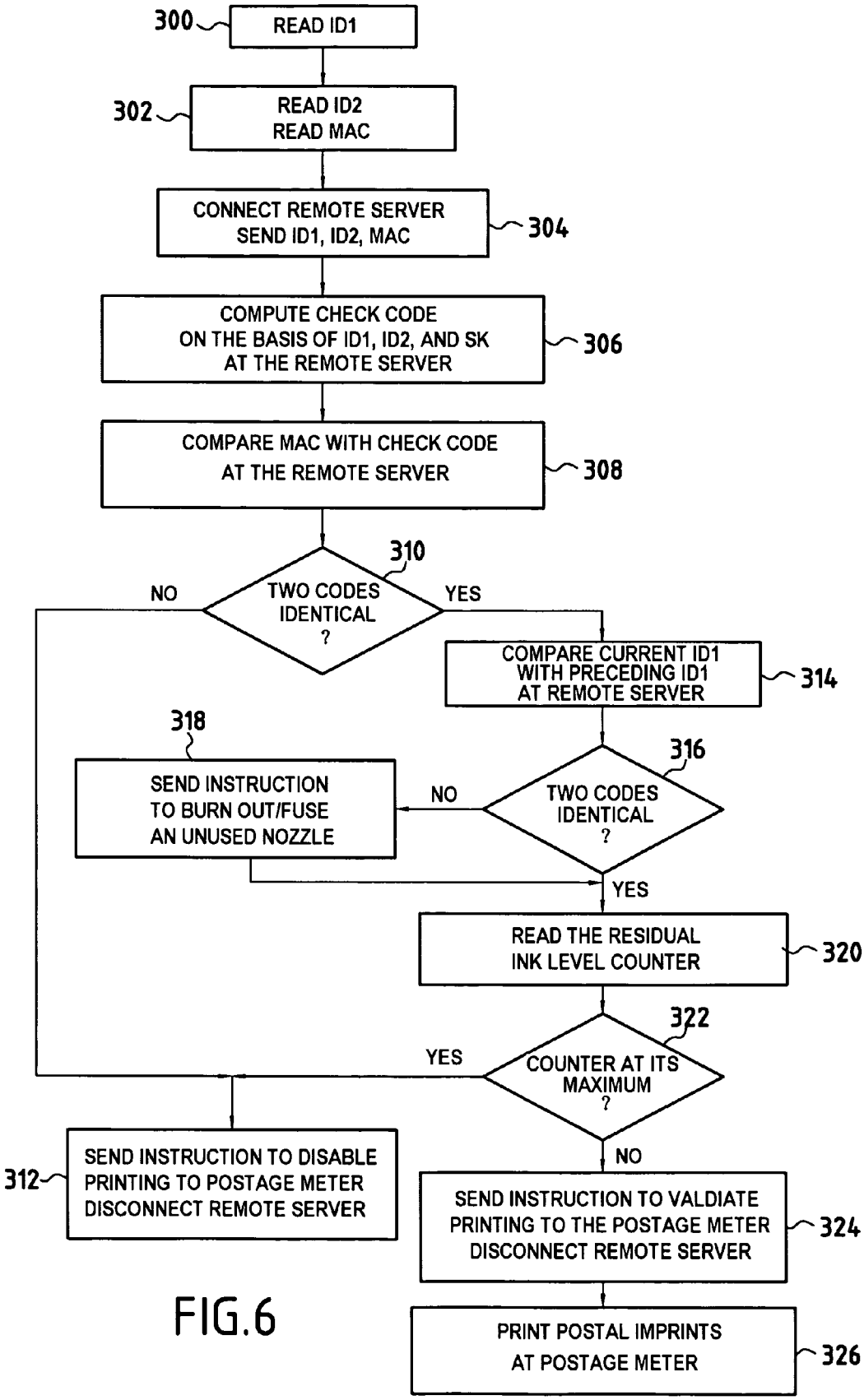

A second example showing the same operations for making data interchange between the print module and the base of the postage meter secure is shown in the flow chart of FIG. 6.

However, in the second example, the process of making data interchange secure is performed between the print module 20 and the remote computer server 14 to which the base 22 of the postage meter is connected. This more secure configuration avoids the need to store the secret key and the encryption algorithm at the postage meter. Firstly, in a first step 300, as above, the processor means 220 act via the electrical contacts 24 to read the first identity number ID1 corresponding to the manufacturer's code of the print module. Then, also, in a step 302, and via the same contacts, the processor means 220 of the base of the postage meter read the unused nozzles corresponding respectively to the second identity number ID2 and to the MAC. In another step 304, the postage meter 10 then connects to the remote computer server 14 and sends it the numbers ID1 and ID2 and the MAC, the server, in a following step 306, computing a check code on the basis of the enciphering of ID1 and ID2 received from the postage meter by means of the original secret key SK stored with its encryption algorithm in the remote server 14. In a step 308, the MAC received from the print module is then compared with the MAC generated in the computer server, and, if they are not identical (answer to the test of step 310 "no"), and optionally after a predetermined number of fruitless attempts, and before disconnecting, an instruction to disable printing is sent to the postage meter in a last step 312. Otherwise (answer to the test of step 310 "yes"), in a step 314, and at the remote server, the identity number ID1 that has just been read is compared with the identity number ID1 that was read (and recorded in the remote server 14) the last time the postage meter was switched on. If these two numbers are different (answer to the test of step 316 "no"), this means that the print module has been changed between successive occasions on which the postage meter has been switched on, and so, in a following step 318, an instruction is sent to the postage meter to burn out one of the unused nozzles of the residual ink level counter. Otherwise (answer to the test of step 316 "yes"), in a step 320, the residual ink level counter is read. If the counter is at its maximum value, i.e. if all of the nozzles of which it is constituted are burnt out (answer to the test of step 322 "yes"), then the process goes to the last step 312 in which an instruction to disable printing is sent. Otherwise (answer to the test of step 322 "no"), the remote server 14 can, in a step 324, prior to disconnecting, send back to the postage meter a validation instruction for authorizing the postage meter to run the process of printing postal imprints that incorporates updating the residual ink level counter as shown in FIG. 7, in a following step 326.

Operation of the residual ink level counter is explained below with reference to FIG. 7. Each time printing takes place, in a first step 400, the ejected droplets are counted, and their volume is deducted from the initial volume of the ink reservoir. So long as the resulting volume does not cross a predetermined threshold (answer to the test of step 402 "no"), droplet counting continues, and it is only when said threshold is crossed (answer to the test of step 402 "yes") that, in a step 404, one of the unused nozzles forming the residual ink level counter is burnt out. The counter is then read in the following step 406, and the printing process continues so long as the counter has not reached its maximum value, whereupon the ink reservoir of the print module is then considered to be empty and, in the end step 410, printing is disabled. Thus, once all of the nozzles forming the counter have been destroyed, and since nozzle melting is irreversible, it becomes impossible to do further printing with the print module even if its reservoir is refilled with ink, because, for the base of the postage meter, the reservoir will always be considered to be empty.

Naturally, the invention is not limited to the above-described embodiments alone, and, for example, it is possible to imagine that the MAC can be read by a contactless reading method rather than via contacts external to the print module by reading certain unused nozzles of the print module. For this purpose, the print module can have an identity label of the Radio-Frequency Identity (RFID) tag type including said MAC and responding to interrogation from a conventional transponder read circuit disposed in the base of the postage meter. It is also possible to imagine, more simply, for the MAC to be written directly on a label accompanying the print module and for it to be input by an operator into the postage meter. These two solutions are advantageous, for example, when unused nozzles are available only for ID2 creation and for the residual ink level counter.

What is claimed is:

1. A method of disabling operation of a disposable print module that has an ink reservoir and a plurality of ink ejection nozzles including unused nozzles, and that serves to be mounted on a base of a postage meter, the method comprising:

forming a residual ink level counter using a determined first group of said unused nozzles;

determining a volume of ink consumed;

destroying one of said unused nozzles of said residual ink level counter every time said print module is mounted on a different postage meter base;

destroying one of said unused nozzles of said residual ink level counter every time said volume of ink consumed exceeds a predetermined ink level; and disabling operation of the print module when all of said unused nozzles of said residual ink level counter have been destroyed.

2. A method according to claim 1, wherein determining the volume of ink consumed is performed by counting the droplets of ink ejected by said plurality of ink ejection nozzles.

3. A method according to claim 1, wherein said predetermined level of ink is equal to (100/n)% of the total volume of said ink reservoir, the number n corresponding to the number of said unused nozzles forming said first determined group of said unused nozzles.

4. A method according to claim 1, wherein other information relating to the disposable print module, such as a color code or a date of manufacture, is formed on the basis of another determined group of said unused nozzles.

5. A method according to claim 1, further comprising:

forming a secure message authentication code on the basis of a second determined group of said unused nozzles;

reading said secure message authentication code;

comparing said secure message authentication code with a check code; and disabling operation of the print module when the two codes are not identical.

6. A method according to claim 5, wherein said comparison of said secure authentication code with said check code takes place at a remote computer server to which said postage meter base is connected.

7. A postage meter implementing a method according to claim 1.

* * * * *